US011823651B2

(12) United States Patent
Pruzinsky et al.

(10) Patent No.: US 11,823,651 B2
(45) Date of Patent: Nov. 21, 2023

(54) GERM SHIELD DEVICE FOR WIND INSTRUMENTS AND METHOD OF USE

(71) Applicants: Joseph Pruzinsky, Clayton, MI (US); Monica Pruzinsky, Clayton, MI (US)

(72) Inventors: Joseph Pruzinsky, Clayton, MI (US); Monica Pruzinsky, Clayton, MI (US)

( * ) Notice: Subject to any disclaimer, the term of this patent is extended or adjusted under 35 U.S.C. 154(b) by 0 days.

(21) Appl. No.: 17/838,708

(22) Filed: Jun. 13, 2022

(65) Prior Publication Data

US 2022/0406276 A1 Dec. 22, 2022

Related U.S. Application Data

(60) Provisional application No. 63/211,485, filed on Jun. 16, 2021.

(51) Int. Cl.
*G10D 9/02* (2020.01)

(52) U.S. Cl.
CPC ..... *G10D 9/02* (2013.01)

(58) Field of Classification Search
CPC ..... G10D 9/02
See application file for complete search history.

(56) References Cited

U.S. PATENT DOCUMENTS

| | | | | |
|---|---|---|---|---|
| 4,378,724 | A * | 4/1983 | Lamart | G10D 9/03 84/398 |
| 7,615,700 | B2 * | 11/2009 | DiClaudio | G09B 15/06 84/398 |
| 11,328,697 | B1 * | 5/2022 | Stewart | G10D 9/00 |
| 2022/0277712 | A1 * | 9/2022 | Shuck | G10D 9/00 |
| 2022/0406276 | A1 * | 12/2022 | Pruzinsky | G10D 9/02 |
| 2023/0165326 | A1 * | 6/2023 | Shuck | A41D 13/1161 2/9 |

* cited by examiner

*Primary Examiner* — Robert W Horn
(74) *Attorney, Agent, or Firm* — Brennan, Manna & Diamond, LLC

(57) ABSTRACT

The present invention relates to a shield device configured to fit over the mouthpiece of a wind instrument to block droplets and aerosols released by a performer using the instrument. The shield device receives and blocks germs and pathogens in droplets and aerosols and prevents them from spreading. The shield device does not interfere with the functionality and operation of the instrument and is configured to be positioned in front of the nose and mouth of a performer at a distance of up to a few inches.

20 Claims, 7 Drawing Sheets

GERM SHIELD DEVICE FOR WIND INSTRUMENTS AND METHOD OF USE

CROSS-REFERENCE TO RELATED APPLICATION

The present application claims priority to, and the benefit of, U.S. Provisional Application No. 63/211,485, which was filed on Jun. 16, 2021, and is incorporated herein by reference in its entirety.

FIELD OF THE INVENTION

The present invention relates generally to the field of accessories for use with musical instruments to help in preventing the spread of germs and pathogens. More specifically, the present invention relates to a plastic shield that is configured to removably attach to a musical instrument, such as a wind instrument. The shield has a hole for fitting the shield over the mouthpiece and extends a few inches up the length of the instrument neck for blocking the forceful pre-breaths, the musician inhaling and exhaling, between playing notes and blocking saliva droplets and aerosols released by a performer using the instrument. The shield device comes in different shapes and sizes to fit over various mouthpieces and neck sizes to accommodate different wind instruments. Accordingly, the present disclosure makes specific reference thereto. Nonetheless, it is to be appreciated that aspects of the present invention are also equally applicable to other like applications, devices and methods of manufacture.

BACKGROUND

By way of background, a wind instrument is a musical instrument made of one or more tubes, usually made of metal, such as brass, and some instruments such as a trombone, trumpet, tuba, French horn and others may be curved in various ways, and others, such as a flute may be straight. Wind instruments normally have one narrow end into which a musician blows, and a second end from which sound emerges, which is usually wider than the first end. Generally, performers and musicians use their breath to produce sound using horn family or wind instruments and specifically, by pressing their lips against a metal cup-shaped mouthpiece. The mouthpiece helps to control the air flow and amplify the sound.

A performer playing a wind or horn instrument can spread germs and pathogens to others near to the performer when playing of the wind or horn instruments. The wind or horn instruments have been identified as potentially being a high-risk activity for the transmission of communicable pathogens like of SARS CoV-2 and others. Further, as distance between performers and audience members is less at an event, the performers and those around them are exposed to germs and illness.

When playing a horn instrument, a performer produces an aerosol and droplets from the moisture contained in his or her mouth and lungs that act as a carrier for transmission of pathogens and other germs. The aerosols and droplets are deposited on various surfaces and contact other performers and those within a relatively close proximity to the performer. While social distancing is the most effective mitigation technique for preventing the transmission of such germs, maintaining social distance is not always possible in a performance or orchestra setting.

Many performers use surgical masks with slits to avoid the transmission of pathogens during their performance. Wearing of surgical masks is not only uncomfortable for performers but can also interfere with playing the instrument. The mask can obstruct or make the blowing of air and the playing of the instrument difficult. Performers, as such, desire an improved device that is comfortable to use, can prevent and/or slow down the spread of germs while not interfering with the playing of the instruments.

Therefore, there exists a long-felt need in the art for a germ shield device that can be easily and removably attached to a horn or wind instrument for preventing and/or slowing the spread of germs to others while playing a musical instrument. There is also a long-felt need in the art for a horn or wind instrument germ guard device that allows a performer to easily use the instrument while blocking breath and germs at a few inches from the performer's mouth. Additionally, there is a long-felt need in the art for a shield device that maximizes protection against the spread of germs, viruses, and bacteria without impeding the use of the instrument. Moreover, there is a long-felt need in the art for a germ shield device that eliminates the requirement of using a slit surgical masks or face shield for preventing transmission of germs and pathogens during a performance. Further, there is a long-felt need in the art for a novel protective device that can be attached to a mouthpiece of horn instruments for protecting performers, conductors and others in the nearby audience from being exposed to germs and illnesses during musical, theatrical or band performances. Finally, there is a long-felt need in the art for a horn or wind instrument germ guard device that does not interfere with the use of horn or wind instrument and maximizes protection from the spread of germs and pathogens in a simple and convenient manner.

The subject matter disclosed and claimed herein, in one embodiment thereof, comprises a one-piece molded plastic shield device designed to be attached to a horn or wind instrument to increase the protection against the spread of germs, viruses, and bacteria without interfering with the use of the horn or wind instrument. The shield device further includes a shaped configuration, such as a generally circular or square one-piece plastic device. The shield includes a base with a hole therein. The hole may be centrally disposed or may be offset from the center depending on the instrument configuration. A wall extends outwardly from a periphery of the base. The wall extends in a perpendicular direction to the plane of the base. The hole is used for accommodating a mouthpiece of the instrument and for mounting the shield to the instrument. The shield receives and blocks droplets and aerosols released by a performer of the instrument preventing the spread of germs and pathogens which are found in the droplets and aerosols.

In this manner, the wind instrument germ protection guard device of the present invention accomplishes all of the foregoing objectives and provides performers with a plastic shield that is removably attached to the mouthpiece and/or neck of the instrument. The shield blocks the breath and germs emitted in droplets and aerosols from a performer and prevents and/or slows the spread of germs to others. The shield does not interfere with the use of the instrument and eliminates the need for wearing a surgical mask while using a horn or wind instruments.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a removable shield device designed to be attached to a wind instrument. The shield further includes a generally circular one-piece guard. The device includes a base having a hole therein. A wall extending from the periphery of the base, and the wall extends perpendicularly to the plane of the base. The hole is used for accommodating a mouthpiece of the horn or wind instrument for mounting the shield to the horn instrument, such that the shield collects, receives, and blocks droplets and aerosols released by a performer of the instrument and helps in preventing the spread of germs and pathogens that are contained in the droplets and aerosols.

In yet another embodiment, the shield device is made of a clear, durable, and rigid plastic.

In yet another embodiment, the plastic is polyethylene terephthalate (PET), paper, postconsumer waste or other recycled content.

In yet another embodiment, the shield device is positioned between three and six inches from the mouth of a performer using the horn or wind instrument.

In yet another embodiment, a wind instrument germ guard is disclosed. The guard includes, in one embodiment, an injection molded plastic shield. The device features a shaped base, such a geometric shape of round, square, rectangular, triangular, or other more fanciful shapes, such as a star, heart, or shape which may compliment the performer or performance and the shield may be configured to accommodate a marketing or other theme. A continuous wall extending from edges of the base, and the continuous wall is ridged at some of the portions. The wall covers the front surface of the base, and a hole is disposed in the base. The hole is used for attaching the shield to the mouthpiece of the instrument, and the front surface and the wall together form a blocking area for blocking droplets and aerosols released by a performer to prevent further spread of germs and pathogens. The hole may also have a flexible gasket surrounding the hole, such as a latex material, to form a seal between the instrument and the shield. The flexible gasket has a slit in it to allow for insertion of the instrument.

In yet another embodiment, the guard device is positioned in front of the mouth and nose of a performer using the instrument.

In yet another embodiment, the guard device does not cover the opening and throat of the mouthpiece.

In yet another embodiment, the guard device can be of any geometrical, fanciful or theme shaped so as to compliment the preferences of the performer or the performance in which the individual is performing.

In yet another embodiment, a method of blocking droplets and aerosols released by a performer during the use of a horn or wind instrument is described. The method includes the steps of providing a shield device having a hole for mounting the guard to the horn instrument. Next, attaching the device to the mouthpiece and/or neck of the horn or wind instrument by sliding the mouthpiece through the hole. Allowing the gasket or bladder to create a seal around the instrument and then using the instrument for playing a sound, music, melody. Then receiving, collecting, and blocking droplets and aerosols by the shield device without interfering with use of the instrument.

Numerous benefits and advantages of this invention will become apparent to those skilled in the art to which it pertains upon reading and understanding of the following detailed specification.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
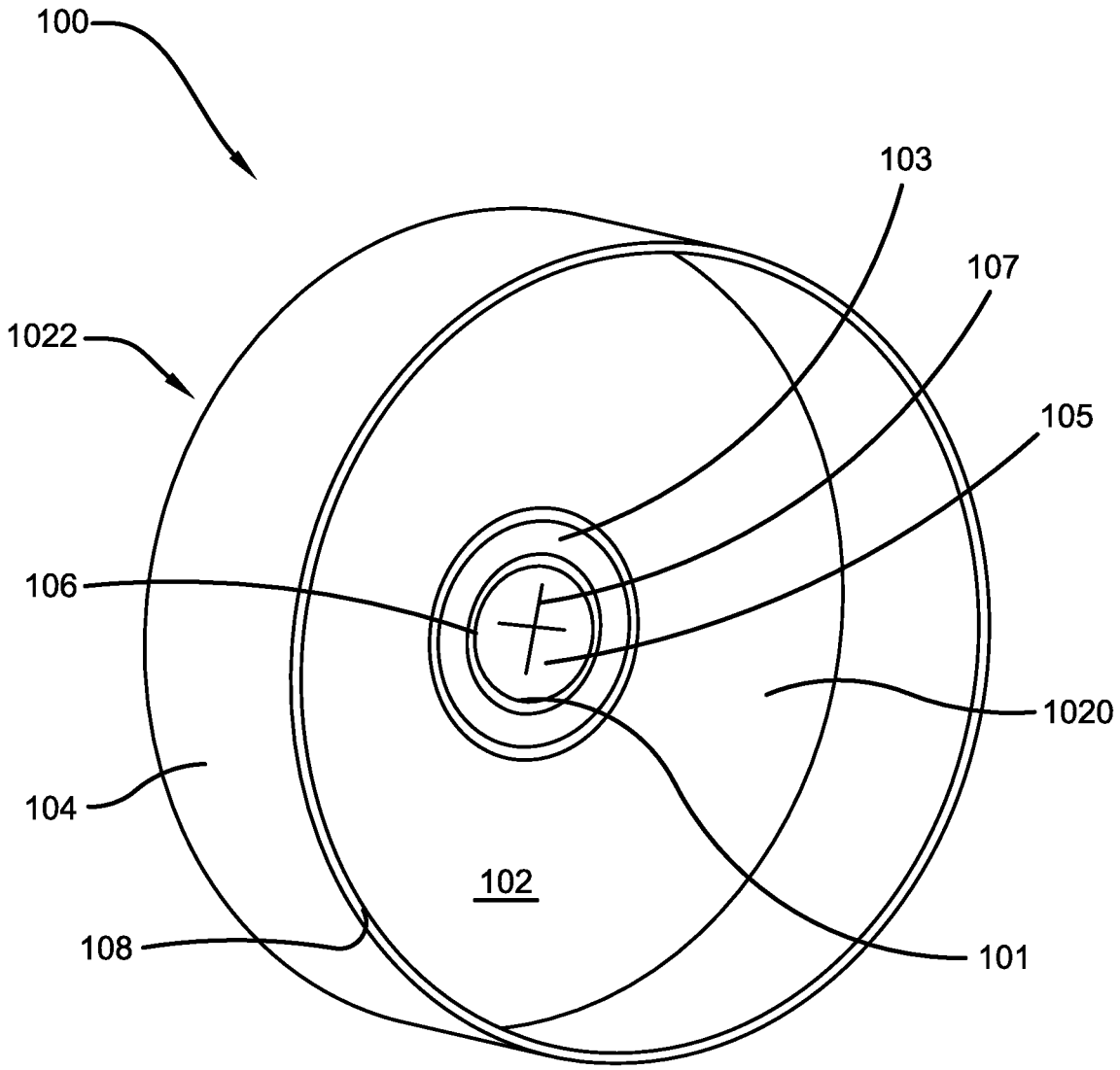
FIG. 1 illustrates a perspective view of one potential embodiment of the horn or wind instrument guard or shield device of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long-felt need in the art for a protective germ shield device that can be easily and removably attached to a horn or wind instrument for preventing and/or slowing the spread of germs to others while playing a wind instrument. There is also a long-felt need in the art for a horn or wind instrument guard that allows a performer to easily use the horn or wind instrument while blocking the breath and germs at a few inches from the performer's mouth. Additionally, there is a long-felt need in the art for a shield device that maximizes protection against germs, viruses, and bacteria without interfering with the use of a horn or wind instrument. Moreover, there is a long-felt need in the art for germ shield device that eliminates the requirement of using slit surgical masks or face shields for preventing transmission of germs and pathogens. Further, there is a long-felt need in the art for a novel protective device that can be attached to a mouthpiece of a horn or wind instrument for protecting performers, conductors and other members of the audience from being exposed to germs and illnesses during musical, theatrical or band performances. Finally, there is a long-felt need in the art for a horn or wind instrument germ guard that does not interfere with the use of a horn instrument and maximizes protection from germs and pathogens in a simple and convenient manner.

The present invention, in one exemplary embodiment, a horn instrument germ shield is disclosed. The shield device, in one embodiment, includes an injection molded plastic shield device. The device features a rectangular base, a continuous wall extending outwardly from a peripheral edge of the base. The continuous wall is ridged at some of the portions of the base or periphery. The wall covers the front surface of the base, and a hole is disposed in the base. The hole is used for attaching the guard to the mouthpiece of the instrument. The front surface and the wall together form a blocking area for blocking droplets and aerosols released by a performer of the horn or wind instrument and thereby preventing the spread of germs and pathogens.

Referring initially to the drawings, FIG. 1 illustrates a perspective view of one potential embodiment of horn instrument germ guard device of the present invention in accordance with the disclosed specification. The horn or wind instrument germ guard device 100 of the present invention is a shield configured to be removably attached to a wind instrument to prevent the spread of germs or bacteria during forceful pre-breaths between played notes that protects the performer, as well as those people near the performer, from exposure to the germs and pathogens. More specifically, the guard device 100 is a generally round shield having a base 102 and a continuous annular wall 104 extending along the periphery of the base 102. The shield 100 has a thickness between 1 and 10 mils with between 3 and 6 mils being preferred. A hole 106 is disposed around the center of the base 102 and is configured to fit over mouthpiece of a horn instrument for mounting the device 100 over the mouthpiece and/or neck of horn instrument. The hole 106 has an inner annular ring 101 and an outer annular ring 103. The hole 106 may have a flexible gasket or bladder 105 which has a slit 107 to allow the end of the instrument to be inserted through the hole of the gasket or bladder 105 and then the gasket or bladder 105 seals around the end of the instrument.

The hole 106 has a diameter that is adapted for a mouthpiece or instrument to be able to slide the end of the instrument in the opening. The diameter of the hole 106 may, for example, be slightly larger than the outer diameter of the mouthpiece or neck of a horn instrument and then the gasket or bladder 105 creates a form fitting arrangement. The gasket or bladder is made of a flexible material such as latex, silicone or other suitable material. The base 102 is comprised of a front surface 1020 and a rear surface 1022, such that, upon proper mounting of the shield device 100, the front surface 1020 faces the performer using the horn instrument. The continuous annular wall 104 extends to cover the front surface 1020 and is positioned in a plane perpendicular to the base 102.

The top edge 108 of the shield in the present invention has a wall 104 that is rounded and smooth and the wall 104, together with the base 102, blocks the germs, viruses, and bacteria from spreading and stops at few inches from a performer's mouth without interfering with the use of the horn or wind instrument.

According to the preferred embodiment, the shield device 100 is made of a plastic material such as polyethylene terephthalate (PET), polypropylene, postconsumer waste, paper, paperboard, cellulosic material, carboard or various combinations thereof. The shield 100 may be coated with an anti-fungal, anti-microbial agent, anti-bacterial or other coating to prevent the spread of germs or bacteria. The material preferable has elasticity, rigidity, durability, and deformation resistance and selection of a suitable plastic or other material may easily be made by the one skilled in the art. The shield device 100 may be made of a molded material and may be molded using any molding technique known in the art, such as injection molding.

The shield 100 is preferably transparent, however, the shield 100 can be available in any color or any design and can be made in any suitable geometric shapes including fanciful shapes. Further, the shield 100 has good chemical resistance and very low moisture absorption. If a cellulosic based material is used, it may also be coated with a wax material in order to prevent the cellulosic material from become limp due to the accumulation of moisture from the spray of the performer.

The base 102 is substantially flat but can be slightly concave or convex as per requirement of the performers and design of the mouthpiece and neck of a horn or wind instrument to which the shield 100 is attached.

Figure 2:
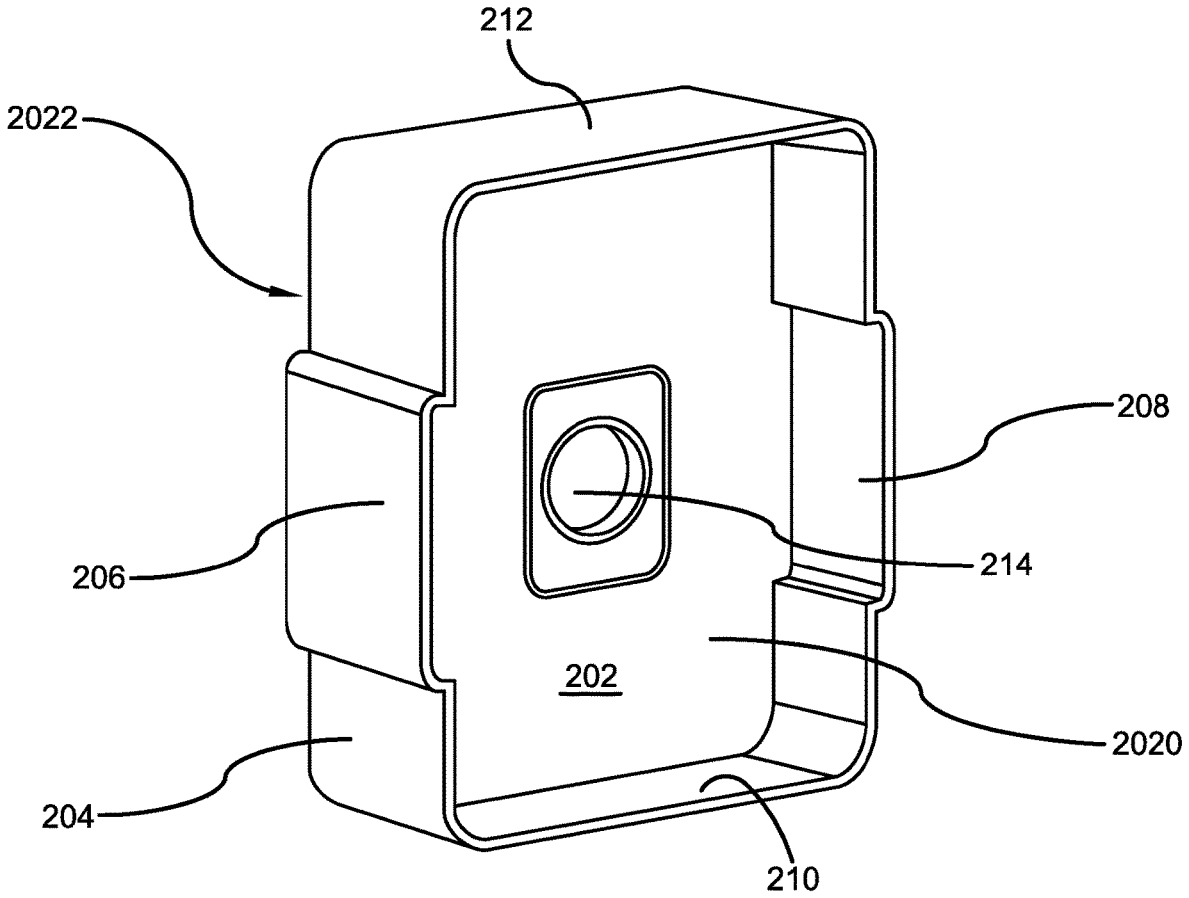
FIG. 2 illustrates a perspective view of another potential embodiment of the protective shield of the present invention in accordance with the disclosed architecture.

FIG. 2 illustrates a perspective view of another embodiment of the protective shield device of the present invention in accordance with the disclosed specification. In the present embodiment, the shield device 200 is a generally square device made of clear, sturdy, and lightweight plastic, such as PET, or polypropylene. The device 200 has a base 202 with a front surface 2020 and a rear surface 2022 such that the front surface 2020 is surrounded by a continuous wall 204. The wall 204 extends along the edges of the base 202 to circumscribe front surface 2020.

More specifically, the wall has two ridged portions 206, 208 and two plain portions 210, 212. The wall 204 along with the base 202 blocks or prevents the breath, droplets and aerosols released by a performer while using and playing a horn or wind instrument. The device 200 acts as a physical barrier for pathogens, bacteria and germs to prevent such undesirable airborne elements from reaching other users and those in the surrounding area near the performer using the horn or wind instrument to which the device 200 is attached via the hole 214. A mouthpiece/neck of the horn instrument easily slides in through the hole and the device 200 is securely attached to the instrument.

Figure 3:
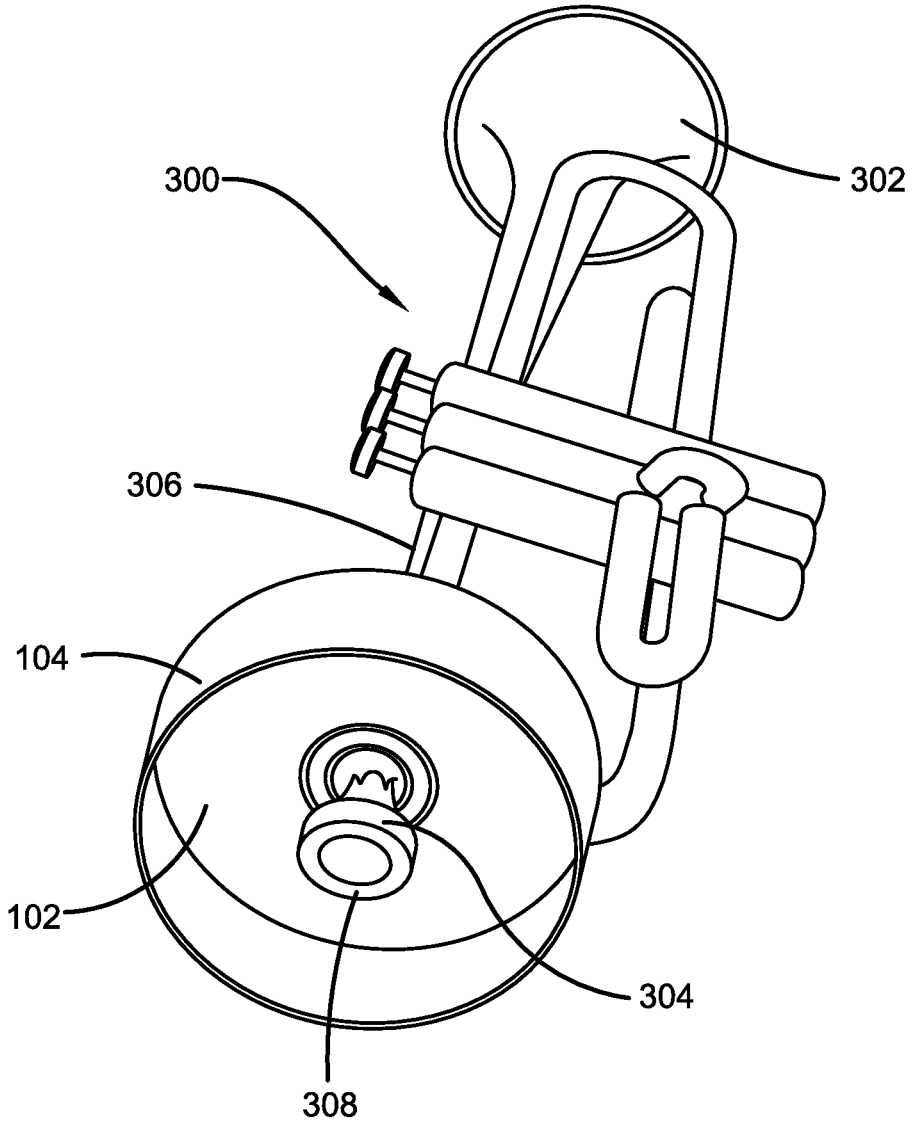
FIG. 3 illustrates a perspective view of a wind instrument that has been equipped with the shield device of FIG. 1 in accordance with the disclosed architecture.

FIG. 3 illustrates a perspective view of an exemplary wind instrument, such as a trumpet, equipped with the shield device 100 of FIG. 1 in accordance with the disclosed specification. As illustrated, a trumpet 300 has a bell 302 at one end and a mouthpiece 304 at opposite end. The mouthpiece 304 is attached to a mouthpiece receiver 306 and is used for blowing air and playing the trumpet using the mouth and lips. A performer uses the mouthpiece 304 for playing sound and therefore, releases droplets, aerosols and air while using the trumpet or other wind instrument 300. In order to block and prevent germs, breathing air and pathogens from reaching even few centimeters away from mouth of the performer, the shield 100 is removably attached to the mouthpiece 304 with the mouthpiece 304 and a part of the mouthpiece receiver 306 sliding through the hole 106 and may be adjusted to be closer or farther away from the performer. The hole boundary grips to the external surface of the mouthpiece 304 and helps in blocking germs and pathogens. To facilitate the sealing of the shield around the mouthpiece 304, a flexible gasket or bladder 105 may be in the hole 106.

As illustrated, the device 100 does not cover or interfere with the opening 308 of the mouthpiece 304 and therefore, a performer can use the wind instrument, such as a trumpet 300, without removing the shield device 100 and without requiring the performer to wear a surgical mask with a mouth slit or face shield.

Figure 4:
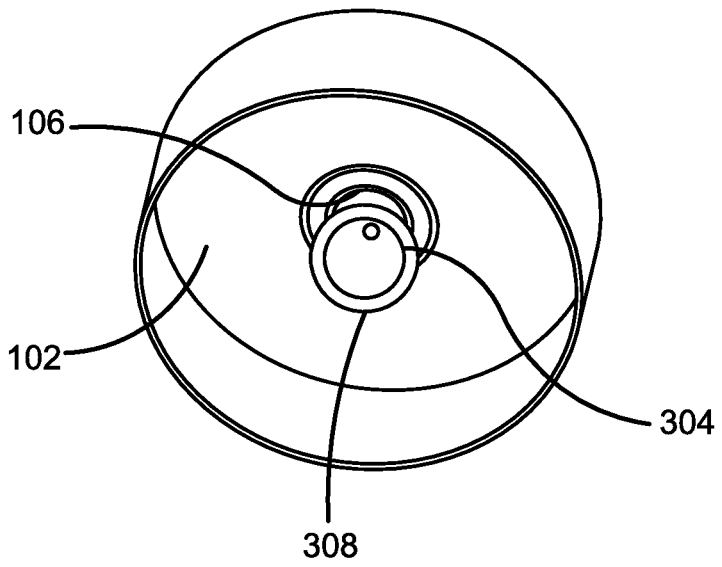
FIG. 4 illustrates a top perspective view of the mouthpiece of the trumpet of FIG. 3 equipped with the shield device of FIG. 1 all in accordance with the disclosed architecture.

FIG. 4 illustrates a top perspective view of the mouthpiece of the trumpet of FIG. 3 equipped with the shield device 100 of FIG. 1 in accordance with the disclosed specification. As illustrated, the mouthpiece 304 is accommodated in the hole 106 and the diameter of the hole 106 is designed to fit around the mouthpiece 304, such that the shield device 100 does not slide along the length of the instrument or the mouthpiece 304 when a performer uses the instrument. The shield device 100 does not obstruct or interfere with the opening 308 and the throat 402 of the mouthpiece 304, thereby allowing uninterrupted use of the trumpet by a user. It should be noted that the device 100 can be designed and used with any brass, wind, or other similar instrument for safe and uninterrupted use.

Figure 5:
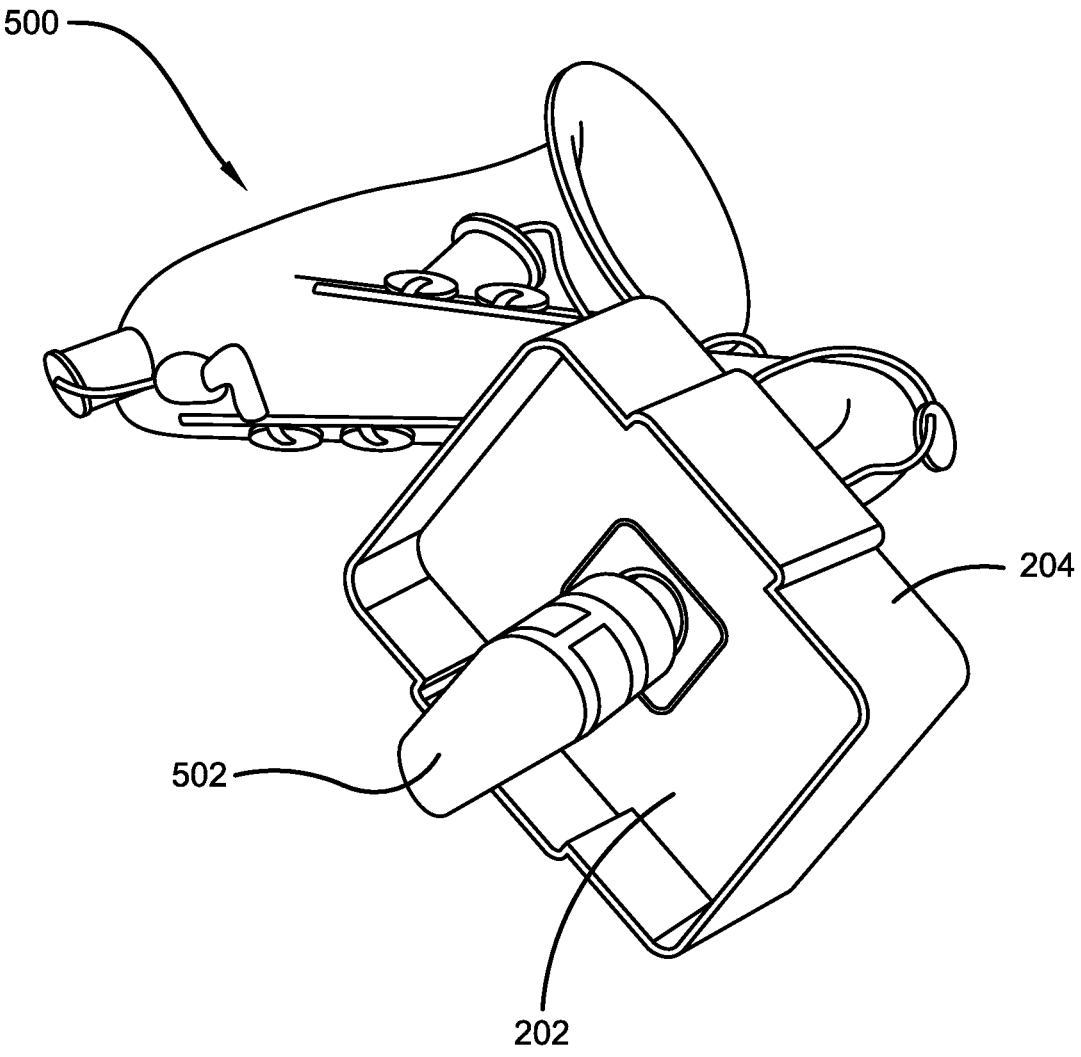
FIG. 5 illustrates a perspective view of another horn or wind instrument with the attached shield device of FIG. 2 installed thereon in accordance with the disclosed architecture.

FIG. 5 illustrates a perspective view of another horn instrument, such as a saxophone, with the attached shield device 200 of FIG. 2 in accordance with the disclosed specification. As illustrated, the shield device 200 is mounted to the mouthpiece 502 of the horn instrument 500, thereby blocking any breath, droplets and aerosols released by a performer using the instrument 500. The wall 204 also helps to prevent the spread of the germs from the base 202 as the wall 204 circumscribes the base 202.

The device 200 is positioned a few inches away from the opening of the mouthpiece 502, thereby it does not obstruct any air passage towards mouth of the performer while blocking all the released droplets, breathing air and aerosols.

Figure 6:
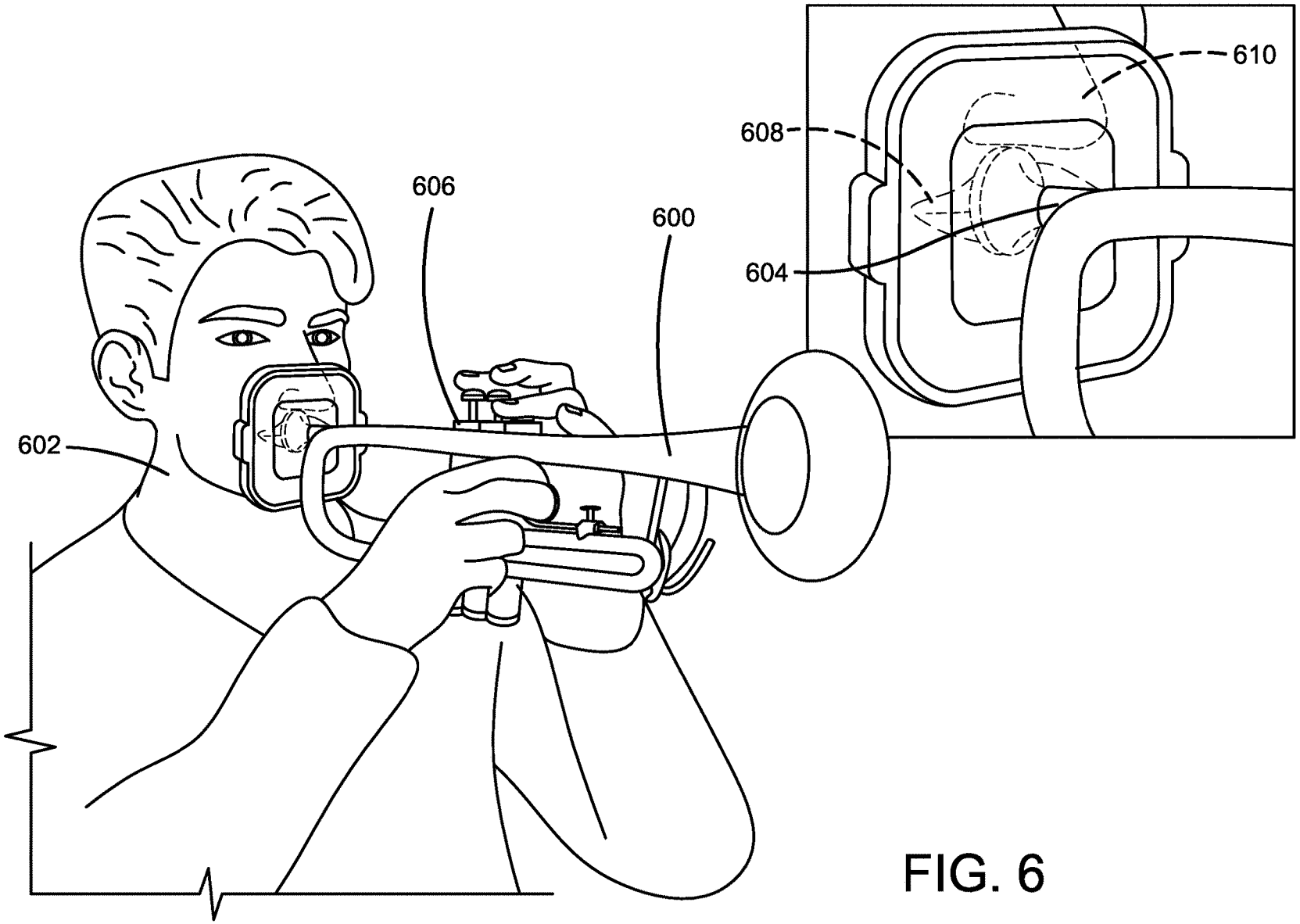
FIG. 6 illustrates a performer using a wind or horn instrument with one potential embodiment of the shield device of the present invention attached thereto to prevent the spread of germs and pathogens in accordance with the disclosed architecture.

FIG. 6 illustrates a performer using a horn instrument with the attached shield device 200 for preventing spread of germs and pathogens in accordance with the disclosed description. With the shield device 200 mounted over the mouthpiece and a few inches up the neck of the instrument 600, the performer 602 can use the mouthpiece 604 and the valves 606 for producing a sound. The shield device 200, when attached to the horn 600, is positioned in front of the mouth 608 and nose 610 of the performer 602 and therefore blocks droplets and aerosols from spreading.

More specifically, the device 200 is dimensioned to cover the mouth 608 and the nose 610. The device 200 can be wiped and cleaned and can be reused while in another embodiment, the device 200 is disposable and recyclable. The functionality of shield devices of other embodiments is achieved in the same manner by blocking breath, droplets and aerosols released by the performer 602.

Figure 7:
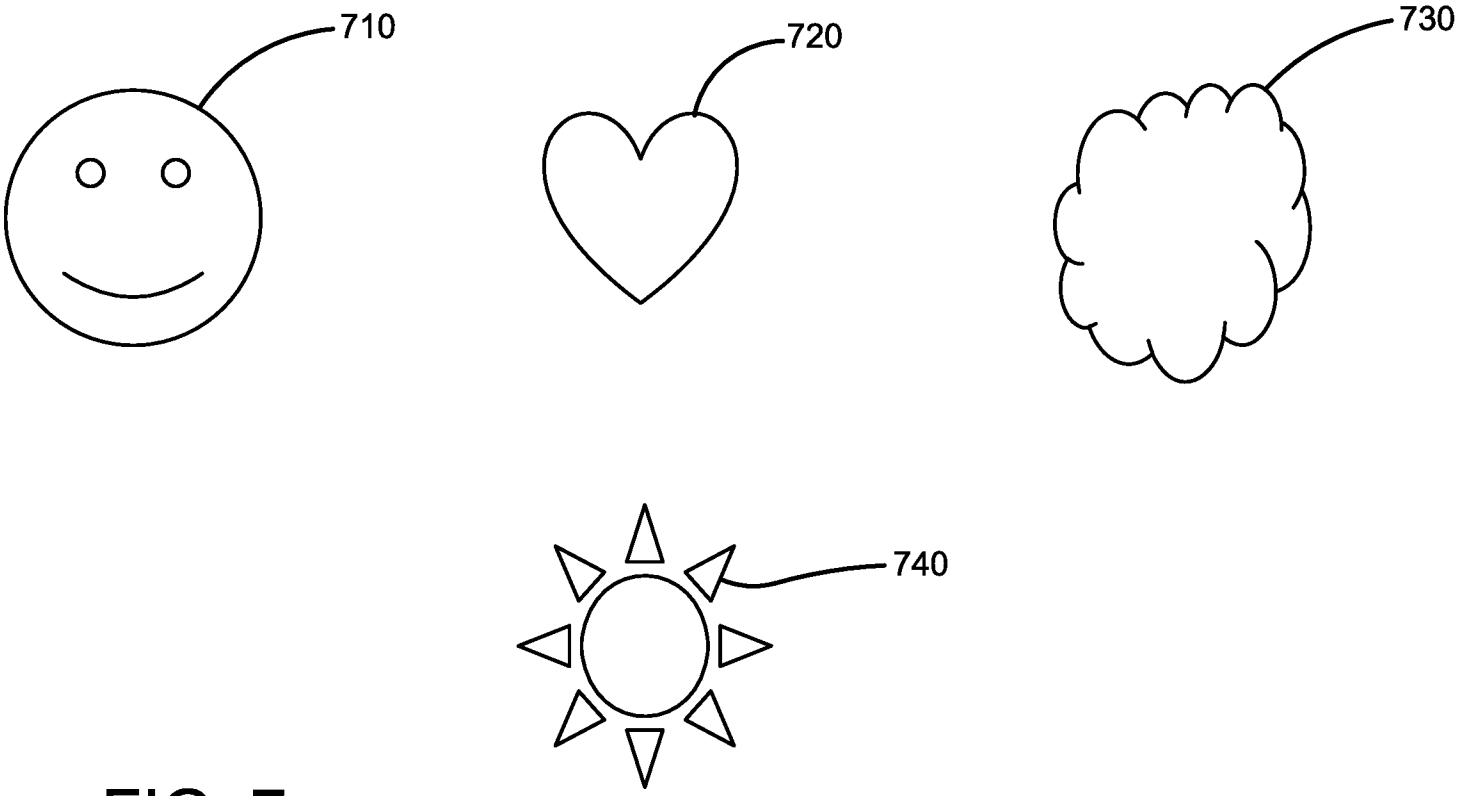
FIG. 7 illustrates a number of potential alternative configurations of the shield device of the present invention.

FIG. 7 illustrates a number of potential alternative configurations of the shield device of the present invention including, without limitation, a smiley face shape 710, a heart shape 720, a cloud shape 730, and a sun shape 740. The shield devices of various embodiments of the present invention prevents and/or slows the spread of germs to others while playing a musical horn instrument and protects others near a performer using a horn instrument from being exposed to germs and illnesses during a musical or band performance. The shield device eliminates the need of using surgical masks and other means to prevent transmission of pathogens and germs.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "shield device", "horn instrument germs shield device", "rectangular shield device", "device" and "horn instrument germ guard device" are interchangeable and refer to the horn instrument germ guard device 100 of the present invention.

Notwithstanding the foregoing, the horn instrument germ guard device 100 of the present invention can be of any suitable size and configuration as is known in the art without affecting the overall concept of the invention, provided that it accomplishes the above-stated objectives. One of ordinary skill in the art will appreciate that the horn instrument germ guard device 100 as shown in the FIGS. are for illustrative purposes only, and that many other sizes and shapes of the horn instrument germ guard device 100 are well within the scope of the present disclosure. Although the dimensions of the horn instrument germ guard device 100 are important design parameters for user convenience, the horn instrument germ guard device 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A protective shield for a musical instrument, the protective shield comprising:

a shield having an opening that is sized and configured to fit around a mouthpiece of the musical instrument and spaced a distance from the mouthpiece;

the shield having a base and the base having a periphery;

the shield having a front surface and a rear surface; and the shield having a wall extending perpendicularly from the base and having a top edge.

2. The protective shield as recited in claim 1, wherein the shield is comprised from one of a polyethylene terephthalate (PET), a polypropylene, a postconsumer waste, a paper, a paperboard, a cellulosic material, a carboard or a combination thereof.

3. The protective shield as recited in claim 1, wherein the shield is coated with at least one of an anti-fungal agent, an anti-microbial agent and an anti-bacterial agent.

4. The protective shield as recited in claim 1, wherein the opening is provided with a flexible gasket or a bladder.

5. The protective shield as recited in claim 4, wherein the flexible gasket or the bladder is comprised of a silicone, a latex or another flexible material.

6. The protective shield as recited in claim 5, wherein the flexible gasket or the bladder forms a seal around the mouthpiece.

7. The protective shield as recited in claim 4, wherein the flexible gasket or the bladder comprises a slit.

8. The protective shield as recited in claim 1, wherein the shield is a geometric shape.

9. The protective shield as recited in claim 1, wherein the shield is a fanciful shape.

10. The protective shield as recited in claim 1, wherein the wall extends outwardly from the front surface and the rear surface faces towards the mouthpiece.

11. The protective shield as recited in claim 8, wherein the geometric shape is one of a rectangle, a circle or a square.

12. The protective shield as recited in claim 9, wherein the fanciful shape is one of a heart, a cloud, a smiley face or a star.

13. A combination musical instrument and protective device, the combination comprising:

a wind instrument having a mouthpiece; and a guard comprised of a front surface, a rear surface, an opening sized and configured to snugly fit over the mouthpiece, a base extending outwardly from the opening and having a perimeter, and a wall extending upwardly from the base.

14. The combination as recited in claim 13, wherein the guard is comprised of at least one of a polyethylene terephthalate (PET), a polypropylene, a postconsumer waste, a paper, a paperboard, a cellulosic material, a carboard or a combination.

15. The combination as recited in claim 13, wherein the guard is coated with an anti-fungal coating, an anti-microbial coating or an anti-bacterial coating.

16. The combination as recited in claim 13 further comprising a flexible bladder or a gasket having a slit.

17. The combination as recited in claim 13, wherein the opening has an inner annular ring and an outer annular ring.

18. A germ shield system comprising:

a mouthpiece connected to a wind instrument;

a germ shield positioned over the mouthpiece, the germ shield having an opening having an inner annular ring and an outer annular ring;

a base extending out from the opening and having a periphery and a wall extending upwardly from the base; and the germ shield made from one of a polyethylene terephthalate (PET), a polypropylene, a postconsumer waste, a paper, a paperboard, a cellulosic material, a carboard or a combination thereof.

19. The germ shield system as recited in claim 18, wherein the germ shield is coated with an anti-fungal material, an anti-microbial material or an anti-bacterial material.

20. The germ shield system as recited in claim 18, wherein the germ shield has a thickness of between 1 and 10 mils.

* * * * *